US005483752A

United States Patent [19]

Kreft et al.

[11] Patent Number: 5,483,752

[45] Date of Patent: Jan. 16, 1996

[54] DEVICE FOR HEATING OR COOLING BULK MATERIALS, PARTICULARLY FOR LIGNITE PREHEATING

[75] Inventors: Manfred Kreft, Wetter; Hans-Joachim Klutz, Erftstadt, both of Germany

[73] Assignees: Jöst GmbH & Co., KG, Dülmen; Rheinbraun AG, Cologne, both of Germany

[21] Appl. No.: 225,214

[22] Filed: Apr. 8, 1994

[30] Foreign Application Priority Data

Apr. 10, 1993 [DE] Germany ..... 43 11 889.5

[51] Int. Cl.[6] ..... F26B 9/00

[52] U.S. Cl. ..... 34/164; 34/167; 34/177; 34/178

[58] Field of Search ..... 34/164, 167, 168, 34/176, 177, 178

[56] References Cited

U.S. PATENT DOCUMENTS 997,016 7/1911 Slaybaugh ..... 34/164
2,535,109 12/1950 Wigton ..... 34/164
3,667,135 6/1972 Rowell ..... 34/164
4,843,732 7/1989 Cross, Jr. ..... 34/164

FOREIGN PATENT DOCUMENTS 456124 6/1973 U.S.S.R. ..... 34/164
567049 11/1974 U.S.S.R. ..... 34/164
1448 of 1907 United Kingdom ..... 34/164

*Primary Examiner*—Denise L. Gromada
*Attorney, Agent, or Firm*—Anderson Kill Olick & Oshinsky

[57] ABSTRACT

A device for heating or cooling of bulk material including two pairs of vibrating chutes, with each pair being formed of two oppositely inclined chutes mounted one above the other and with each pair being equipped with a unidirectional vibrator, and with vibrating chutes of each pair being connected with a plurality of pairs of oppositely inclined articulated bars, and with vibrating chutes being equipped with flow ducts connected with each other in such a way that heating or cooling medium flows in the flow ducts of the vibrating chutes of each pair in the same direction so that in one chute the directions of flow of the heating or cooling material coincide with the flow of bulk material, and in the other chute they flow in opposite directions.

8 Claims, 2 Drawing Sheets

Figure 1:
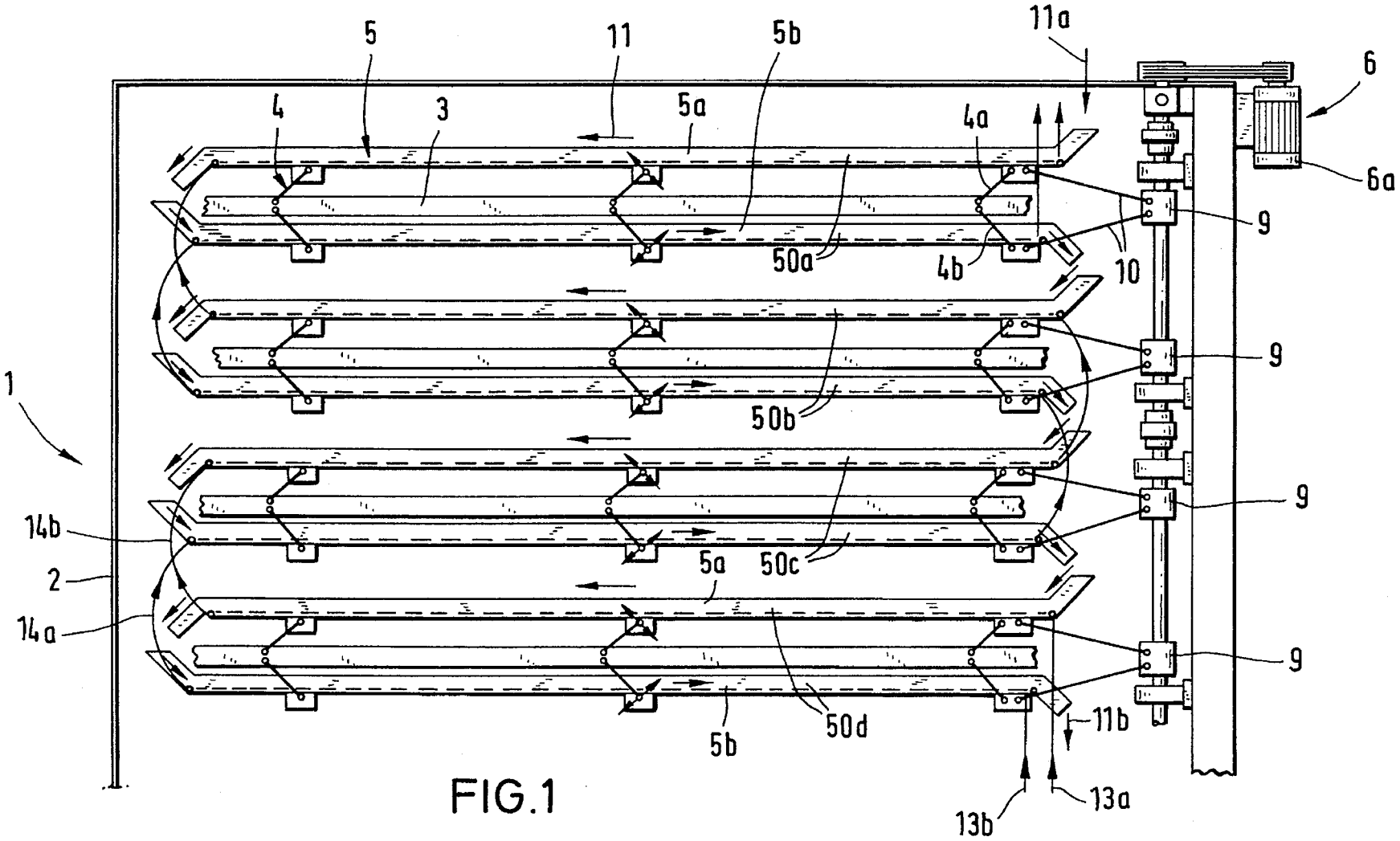

DEVICE FOR HEATING OR COOLING BULK MATERIALS, PARTICULARLY FOR LIGNITE PREHEATING

The invention relates to a device for heating or cooling bulk material, particularly to a lignite preheater.

EP-B-0 268 819 describes a conditioning unit for bulk material which is provided with disks arranged in different planes and heated separately. As in the case of the device according to this invention, such a unit is suitable for bulk material with evaporable ingredients, for instance, for preheating lignite, hard coal, peat coal, waste wood, clarifier sludge, waste sludge, contaminated earth, catalysts, zeolites or filter cake. By means of a vibrating conveyor, the material is fed to the different disks and is preheated by the indirect heat-exchange method, dried or, depending on the use intended, it is also cooled.

A drying and cooling device with a segmented vibrating chute is shown in EP-B-O 030 947 or DE-C-21 53 453.

Size and throughput of disk heaters or disk coolers are restricted for technical reasons. An essential problem of vibrating chutes consists in the large space they require and especially in the lower efficiency range of the heat transfer stream. This portion has to be compensated by several adequately designed conveyors connected in series. Another problem is due to the fact that large dynamic loads caused by several independent vibrating conveyors are transferred to the ambient equipment so that oversized foundations are needed and atmospheric vibrations are emitted.

The aim of the invention is to design a compact device which requires an essentially smaller surface area and which permits a high throughput, and to reduce the forces and vibrations emitted into the ambient equipment or the foundations, respectively.

Said aim is achieved by means of the device mentioned above and characterized in that

- it is equipped with at least four vibrating chutes with equal dead load, each arranged one above the other and alternately inclined in the opposite direction, thus ensuring a closed conveying cycle for the bulk material,
- a pair of two vibrating chutes each mounted one above the other is equipped with one vibrator moving in the same direction,
- the vibrating chutes with vibrators of the type mentioned above are fixed to articulated bars each inclined in the opposite direction and articulated individually, and
- the vibrator of the pair of chutes followed by another pair of vibrating chutes is designed for a 180° phase shift.

The invention provides for a device which has many advantages. Thus, several vibrating chutes can be arranged in the surface area required by a single conveying chute, i.e. one vibrator is used for each pair of chutes, but with individual articulated bars each inclined in the opposite direction, for alternate feeding and withdrawal of the bulk material, thereby simultaneously compensating the inertia forces which occur during the operation. The two stacked chutes with a single vibrator perform horizontal parallel vibrations and the horizontal forces are added, whereas the articulated bars are arranged in such a way that the vertical forces acting on one chute are compensated by those of the other chute.

The 180° phase shift for each pair of chutes also permits the compensation of the horizontal forces of one chute by those of the other chute so that all inertia forces are balanced.

According to the invention, the vibrating chutes are of a rectangular shape and equipped with external vibrators attached to the end sections of the chutes. The design may be further improved by connecting all stacked vibrators to a joint shaft with drive motor and, if required, the invention also provides for two external drive shafts to be synchronized in the opposite direction.

Feeding the heating agent to the vibrating chutes may be a special problem because of its additional load and mass acting on the chutes. To permit load compensation also in this case, the invention provides for feeding the heating liquid from one vibrating chute to the next but one and so forth.

The heating liquid can thus be fed in two part streams to the device, i.e. the invention provides for simultaneous feeding from bottom to top via two inlets on the last chute and the last but one, the heating liquid being withdrawn from the upper end of the second and/or first vibrating chute.

This feed system ensures that a pair of chutes vibrating in the same direction is fed with a part stream counter-current to and another co-current with the flow of bulk material being conveyed. Hence, the load of one stream is compensated by that of the other within a section of such a pair of chutes.

The invention also provides for ducts in which the heating or cooling liquid flows along the vibrating chutes. In this case, a further embodiment provides for flow ducts arranged along the side walls of the vibrating chutes so that the walls can also be heated or cooled.

If, according to the invention, the heat exchange takes place with the aid of a liquid circulated in the flow ducts, an additional problem may be involved, i.e. a fluid co-vibrating in the flow ducts produces a dynamic load which exceeds the static load so that cavitation may occur under certain circumstances and, depending on the flow duct design and the materials used, rapid fatigue and rupture cannot be precluded.

According to the invention, the flow ducts are connected to the next but one vibrating chute so that each co-vibrating pair of chutes is supplied with liquid in a counter-current flow. Additionally liquid flows through the adjacent chutes vibrating in opposite direction so that the dynamic load variations of the liquid are reduced to an extent permitting the heating plate and the jacket to be rated as a function of the static load only.

The variable of the dynamic load variations depends only on the length of the conveying chutes and on the portion of the horizontal accelerating moment of these chutes. Due to the fact that only the next but one vibrating chute is supplied with liquid, ducts with moments acting in the opposite direction are connected and form the respective loop.

A device which is configured according to the invention and used in power stations fired with lignite is designed to be fed with process condensate circulated in its ducts.

The invention also provides for flushing connections to be fitted to the flow ducts to remove deposits or similar substances with the aid of a flushing liquid. Particularly when using heating water with a high content of impurities, for instance, from the vapour condensate of lignite, such impurities may settle in the heating or flow ducts. The flushing connections are provided to remove such impurities.

The invention also provides for restriction-type sections to be mounted in the inlet and/or outlet section of the flow ducts, such as baffles, to obtain the required flow pattern. This method ensures that a minimum flow velocity is maintained for avoiding deposits.

A further embodiment of the invention consists in the use of conveying sections of stainless steel with very little surface roughness in order to prevent incrustations on the vibrating chutes in the case of viscous bulk material.

Figure 3:
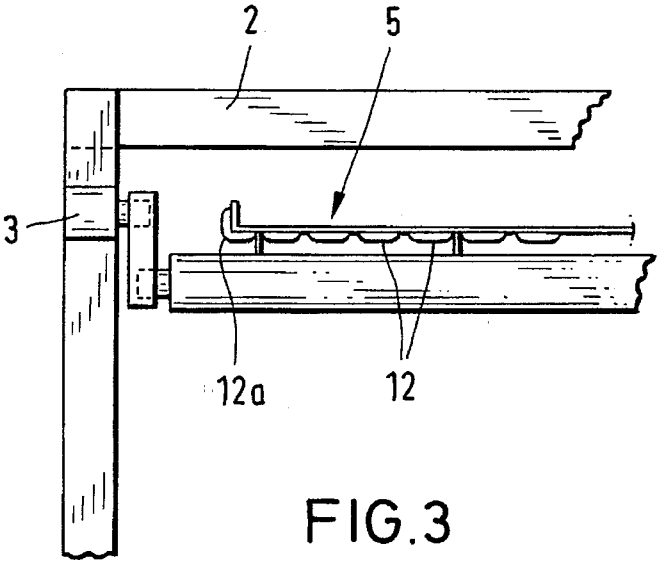
Figure 2:
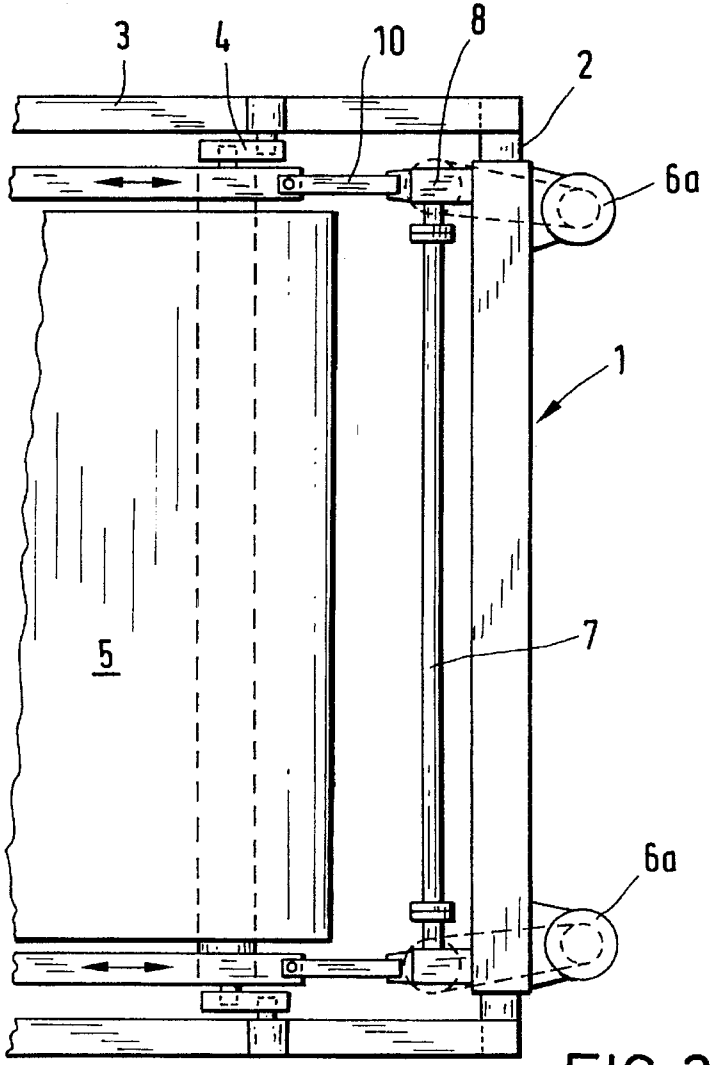

For further details, features and advantages of the invention, refer to the description below and the figures listed below:

FIG. 1 a simplified lateral view of a section of the device according to the invention, FIG. 2 a sectional view of the device according to the invention, FIG. 3 a sectional view marked with arrow III in FIG. 1.

The device marked 1 and described below is a lignite preheater:

Device 1 is equipped with a dash-dotted supporting frame 2 with frame elements 3, which carry vibrating chutes 5 by means of articulated bars 4.

The vibrating chutes 5 are linked to vibrator 6 attached to the ends of supporting frame 2 via two eccentric shafts 8; these shafts are synchronized via shaft 7 and equipped with eccentric vibrators 9 actuating push rods 10.

As can be seen in more detail in FIG. 1, two chutes 5*a* and 5*b* are linked to form a pair of vibrating chutes 50 via a joint eccentric vibrator 9; the pairs of vibrating chutes are marked 50*a*, 50*b*, etc.

Each pair of vibrating chutes 50 has its own vibrator 9, but the articulated bars marked 4*a* and 4*b* are inclined in an opposite direction although they can be moved towards the other, the inclined vibrating chute 5*a* being opposite to vibrating chute 5*b* so that the bulk material is conveyed in the direction of arrow 11. The bulk material stream marked with arrow 11*a* is fed into device 1 at the top and discharged at the bottom, see arrow 11*b*.

FIG. 3 clearly shows that each conveying chute 5 is equipped with flow ducts 12 and the side walls also have a flow duct 12*a*.

In the example illustrated in FIG. 1, the process condensate is used as heating liquid and fed via bottom inlets 13*a* and 13*b* into the lower vibrating chutes 5*a* and 5*b* of the pair marked 50*d*, flexible hoses 14*a* and 14*b* being used to connect flow ducts 12 of one vibrating plate with those of the next but one vibrating plate. This layout permits the liquid to be first piped via lower vibrating chute 5*b* in a counter-current flow to the bulk material stream and then via the adjacent vibrating chute 5*a* of the pair 50*d* in a co-current flow, the bulk material stream in the adjacent pair of vibrating chutes 50*c* being reversed. Small arrows in the drawing indicate the flow directions. It is thus evident that the loads due to the flow directions are compensated in pairs, and it is the same with the conveying streams (one pair by the next but one pair) because of opposite vibration amplitudes of the vibrating chutes so that a balance of forces is achieved.

No details are shown in the figures With regard to the possibility of integrating baffle plates into the inlet and outlet sections of the flow ducts in order to prevent incrustations on the walls due to impurities, and no details are indicated with regard to the stainless steel conveying sections of chutes 5 with a low surface roughness.

Is is of course possible to modify the embodiment described above in many technological details without abandoning the basic configuration. The device may, for instance, be equipped with a number of double-pair assemblies of the chutes described and be designed so as to ensure a balance of loads and forces within each double-pair assembly. Moreover, several devices may be installed on a joint foundation with a joint frame structure, the devices being placed in parallel and equipped with a central vibrator and gear, instead of two drive units 6*a* shown in the drawing.

We claim:

1. A device for one of heating and cooling bulk material, comprising:

a plurality of bulk material conveying vibrating chutes having each an equal dead load, arranged one above another and inclined alternatively in opposite directions, the plurality of vibrating chute comprising at least two pairs of vibrating chutes, each pair being formed of adjacent oppositely inclined chutes;

a vibrator associated with each pair of vibrating chutes for vibrating same, the vibrators of the two pairs of vibrating chutes being movable in a same direction with a 180° phase shift;

a plurality of pairs of articulated bars for connecting chutes of each pair together, with articulated bars of each pair being inclined in opposite directions; and a plurality of flow ducts associated with the vibrating chutes;

wherein flow ducts of each separate vibrating chute have a unidirectional flow of fluid medium therethrough, and wherein flow ducts of vibrating chutes having same inclination are so connected with each other that the fluid medium flows through oppositely inclined vibrating chutes of each pair in a same direction, whereby a fluid medium flow direction through the flow ducts of one of the vibrating chutes of a pair of vibrating chutes coincides with a flow direction of the bulk material through the one of the vibrating chutes, and a fluid medium flow direction through the flow ducts of another of the vibrating chutes of the pair of vibrating chutes is opposite to a flow direction of the bulk material through the another of the vibrating chutes.

2. A device as set forth in claim 1, wherein each vibrating chute has a rectangular shape, and wherein the device further comprises external vibrator means.

3. A device as set forth in claim 1, further comprising two joint shafts for driving the vibrators associated with the pairs of vibrating chutes, and a drive motor for driving the joint shafts.

4. A device as set forth in claim 3, further comprising means for synchronizing operation of the two joint shaft.

5. A device as set forth in claim 1, further comprising a common frame for supporting the vibrating chutes.

6. A device as set forth in claim 1, wherein the flow ducts are arranged along the side walls of the vibrating chutes.

7. A device as set forth in claim 1, wherein the flow ducts of each vibrating chute have inlet means and outlet means, wherein the device further has two inlets communicating with the inlet means of the oppositely inclined vibrating chutes of a bottommost pair of oppositely inclined vibrating chutes, and wherein the outlet means of the flow ducts of each vibrating chute is connected with the inlet means of the flow ducts of a following vibrating chute having the same inclination.

8. A device for heating lignite, which is used in lignite-fired power stations, with process condensate, said heating device comprising:

a plurality of bulk material conveying vibrating chutes having each an equal dead load, arranged one above another inclined alternatively in opposite directions, the plurality of vibrating chute comprising at least two pairs of vibrating chutes, each pair being formed of adjacent oppositely inclined chutes;

a vibrator associated with each pair of vibrating chutes for vibrating same, the vibrators of the two pairs of vibrating chutes being movable in a same direction with a 180° phase shift;

a plurality of pairs of articulated bars for connecting chutes of each pair together, with articulated bars of each pair being inclined in opposite directions; and a plurality of flow ducts associated with the vibrating chutes;

wherein flow ducts of each separate vibrating chute have a unidirectional flow of process condensate therethrough, and wherein flow ducts of vibrating chutes having same inclination are so connected with each other that the process condensate flows through oppositely inclined vibrating chutes of each pair in a same direction, whereby a process condensate flow direction through the flow ducts of one of the vibrating chutes of a pair of vibrating chutes coincides with a flow direction of the lignite through the one of the vibrating chutes, and a process condensate flow direction through the flow ducts of another of the vibrating chutes of the pair of vibrating chutes is opposite to a flow direction of the lignite through the another of the vibrating chutes.

* * * * *